US011452337B2

(12) United States Patent
Wang et al.

(10) Patent No.: US 11,452,337 B2
(45) Date of Patent: Sep. 27, 2022

(54) WALKING-ASSISTED AIR-JET INSOLE

(71) Applicant: Jinzhou Wang, Suzhou (CN)

(72) Inventors: Jinzhou Wang, Suzhou (CN); Qinhua Zhang, Wenzhou (CN)

(73) Assignee: Jinzhou Wang, Suzhou (CN)

( * ) Notice: Subject to any disclaimer, the term of this patent is extended or adjusted under 35 U.S.C. 154(b) by 122 days.

(21) Appl. No.: 17/005,339

(22) Filed: Aug. 28, 2020

(65) Prior Publication Data

US 2022/0015506 A1 Jan. 20, 2022

(30) Foreign Application Priority Data

Jul. 20, 2020 (CN) ..... 202010697597.5

(51) Int. Cl.

| | |
|---|---|
| ***A43B 17/03*** | (2006.01) |
| ***A43B 7/08*** | (2022.01) |
| ***A43B 17/08*** | (2006.01) |
| *A43B 21/28* | (2006.01) |
| *A43B 13/20* | (2006.01) |

(52) U.S. Cl.

CPC ..... *A43B 17/03* (2013.01); *A43B 7/081* (2013.01); *A43B 7/087* (2013.01); *A43B 17/08* (2013.01); *A43B 13/20* (2013.01); *A43B 13/203* (2013.01); *A43B 13/206* (2013.01); *A43B 21/28* (2013.01); *A43B 21/285* (2013.01)

(58) Field of Classification Search

CPC ..... A43B 17/03; A43B 17/08; A43B 7/081; A43B 7/087; A43B 13/20; A43B 13/203; A43B 13/206; A43B 21/28; A43B 21/285

USPC ..... 36/29

See application file for complete search history.

(56) References Cited

U.S. PATENT DOCUMENTS

| | | | | | |
|---|---|---|---|---|---|
| 2,408,792 | A | * | 10/1946 | Margolin | A43B 7/142 36/147 |
| 3,273,265 | A | * | 9/1966 | Reinert | A43B 7/081 36/3 R |
| 3,676,940 | A | * | 7/1972 | Shively | A43B 13/223 248/362 |
| 4,223,456 | A | * | 9/1980 | Cohen | A43B 13/206 36/32 R |
| 4,290,211 | A | * | 9/1981 | Csengeri | A43B 7/082 36/3 B |
| 4,521,979 | A | * | 6/1985 | Blaser | A43B 17/02 36/43 |

(Continued)

*Primary Examiner* — Alissa J Tompkins
*Assistant Examiner* — Dakota Marin
(74) *Attorney, Agent, or Firm* — Bayramoglu Law Offices LLC

(57) ABSTRACT

A walking-assisted air-jet insole includes an insole base. A plurality of pressed-air outlet units that can generate airflow based on stepping pressure are provided on the insole base; the pressed-air outlet unit includes a cavity for retaining air. An upper part of the insole base is provided with an upper air hole that communicates with the cavity, and a lower part of the insole base is provided with an air sac part that is elastically deformed and restored based on the stepping pressure. A volume of the cavity can be changed based on the elastic deformation and restoration of the air sac part. A lower end of the air sac part is provided with a convex column that moves up and down based on the stepping pressure. The cavity includes an upper cavity portion and a lower cavity portion from top to bottom.

14 Claims, 7 Drawing Sheets

(56) References Cited

U.S. PATENT DOCUMENTS 4,619,055 A * 10/1986 Davidson ..... A43B 7/146 36/28
5,233,767 A * 8/1993 Kramer ..... A43B 13/206 36/35 B
5,400,526 A * 3/1995 Sessa ..... A43B 7/081 36/3 R
5,992,052 A * 11/1999 Moretti ..... A43B 7/125 36/103
6,041,518 A * 3/2000 Polycarpe ..... A43B 7/34 36/3 R
6,434,859 B1 * 8/2002 Kim ..... A43B 7/142 36/43
6,681,500 B2 * 1/2004 Moretti ..... A43B 7/125 36/30 R
6,751,890 B1 * 6/2004 Tsai ..... A43B 17/18 36/29
7,225,491 B2 * 6/2007 Reed ..... A43B 13/42 12/142 P
7,703,219 B2 * 4/2010 Beck ..... A43B 17/08 36/43
7,712,229 B2 * 5/2010 Yang ..... A43B 13/181 36/29
7,721,466 B2 * 5/2010 Guo ..... A43B 17/03 36/43
8,191,283 B2 * 6/2012 Basso ..... A43B 17/08 36/43
9,155,355 B2 * 10/2015 Diepenbrock ..... A43B 17/03
10,327,504 B2 * 6/2019 Rehagen ..... A43B 13/20
10,512,301 B2 * 12/2019 Peyton ..... A43B 13/04
10,881,167 B2 * 1/2021 Jeng ..... A43B 13/181
2004/0016148 A1 * 1/2004 Chen ..... A43B 17/06 36/3 R
2004/0098882 A1 * 5/2004 Tuan ..... A43B 17/03 36/29
2006/0213091 A1 * 9/2006 Ometto ..... A43B 17/08 36/141
2010/0170117 A1 * 7/2010 Kim ..... A43B 17/03 36/44
2012/0198729 A1 * 8/2012 Graziani ..... A43B 17/08 36/43
2012/0210604 A1 * 8/2012 Polegato Moretti ... A43B 7/087 36/83
2014/0259742 A1 * 9/2014 Wu ..... A43B 13/181 12/146 B
2015/0272270 A1 * 10/2015 Im ..... A43B 7/088 36/29
2015/0342295 A1 * 12/2015 Moon ..... A43B 7/146 36/43
2016/0309836 A1 * 10/2016 Liu ..... A43B 7/087
2018/0368516 A1 * 12/2018 Mason ..... A43B 7/141
2019/0133252 A1 * 5/2019 Jeong ..... A43B 13/181

* cited by examiner

WALKING-ASSISTED AIR-JET INSOLE

CROSS REFERENCE TO THE RELATED APPLICATIONS

This application is based upon and claims priority to Chinese Patent Application No. 202010697597.5, filed on Jul. 20, 2020, the entire contents of which are incorporated herein by reference.

TECHNICAL FIELD

The present invention relates to a walking-assisted air-jet insole.

BACKGROUND

Insoles are common daily necessities that are typically arranged inside shoes and are in contact with the soles of the feet. At present, most insoles on the market are made of silicone, soft foam and the likes. In order to improve the breathability of the insoles when being worn, the insoles on the market are generally provided with a plurality of air holes that penetrate the upper and lower parts of the insoles, but the improvement in the breathability of the insoles leaves much to be desired when users rest their feet on the insoles. Besides, in order to improve the comfort, some manufacturers usually increase the thickness of the insoles, thereby increasing the resiliency and shock absorbing performance of the insoles when walking or running, but such a design would increase the consumption of the insole materials, and also makes the insoles thicker and heavier.

SUMMARY

In view of the above shortcomings of the prior art, the present invention provides a walking-assisted air-jet insole, which has better breathability and better walking-assisted effect, and is more comfortable to wear.

To achieve the above objective, the present invention provides a walking-assisted air-jet insole including an insole base. A plurality of pressed-air outlet units that can generate airflow based on stepping pressure are provided on the insole base. The pressed-air outlet unit includes a cavity for retaining air. An upper part of the insole base is provided with an upper air hole that communicates with the cavity, and a lower part of the insole base is provided with an air sac part that is elastically deformed and restored based on the stepping pressure. The volume of the cavity can be changed based on the elastic deformation and restoration of the air sac part.

The advantages of the present invention are as follows. When a foot is stepping, the air sac part of the lower part of the insole base and the sole are pressed and deformed, then the air in the cavity can be discharged along the air outlet hole toward the sole of the foot, and the generated airflow can directly act on the sole of the foot, so that the user can directly feel the air ventilation effect of the walking-assisted air-jet insole. After the deformation is restored, the air sac part re-inhales air into the cavity for the next discharge. Furthermore, by means of the elasticity of the material of the insole base, the elastic deformation ability of the air sac part and the reaction force generated by the compressed air in the cavity, the walking-assisted air-jet insole has a walking-assisted effect to some extent when the user wear it and walks, which can improve the comfort during use.

Further, a lower end of the air sac part is provided with a convex column that moves up and down based on the stepping pressure. The cavity includes an upper cavity portion and a lower cavity portion from top to bottom. An upper end of the upper cavity portion is connected to the upper air hole. An inner diameter of the upper cavity portion gradually increases from top to bottom to form a bowl-shaped containing space. The containing space can contain at least an upper end of the convex column when the convex column is driven to move upward. The air sac part includes an annular elastic thin wall. The lower cavity portion is formed by enclosing with the elastic thin wall. An inner diameter of the lower cavity portion gradually decreases from top to bottom. A lower end of the lower cavity portion is connected to the convex column.

Through such arrangements, the lower end of the convex column abuts against and is fitted with the sole, and the convex column can move up and down with the stepping motion of the foot. When the convex column moves upward, the convex column can drive the air sac part to produce pressure and deformation, and at the same time, at least the upper end of the convex column can be inserted upward into the containing space of the upper cavity portion. In this way, the movement distance of the convex column increases, thereby increasing the degree of change of the cavity volume and improving the air discharge effect. Furthermore, the convex part can also improve the deformation effect of the air sac part.

Further, the lower part of the insole base is provided with a plurality of first pits for containing air sac parts of the pressed-air outlet units, and gaps for elastic deformation of the air sac part are formed at intervals between peripheral side walls of the first pits and the air sac parts.

Through such arrangements, the pressed-air outlet unit is arranged in the first pit, and the peripheral side wall of the first pit can limit the position of the air sac part and the degree of deformation of the air sac part when the air sac part is deformed and protruded in the circumferential direction, thereby improving the deformation and restoration effect of the air sac part, and improving the stability and durability of the deformation of the air sac part.

Further, the first pit is formed by enclosing with convex ribs provided in the lower part of the insole base. A peripheral side wall of the first pit is provided by the convex ribs, and adjacent first pits share a side wall formed by a convex rib. The plurality of first pits are distributed in a grid pattern.

Through such arrangements, the convex ribs provided at the lower part of the insole base are used to surround and form the first pit, which is convenient for processing and molding. The convex rib used as a side wall for both the adjacent first pits can improve the density of the first pits, and can further make the adjacent pressed-air outlet units closer to each other so that more pressed-air outlet units are arranged on the insole base to enhance the air ventilation effect.

Further, the plurality of pressed-air outlet units are densely distributed between a forefoot region and a hindfoot region of the insole base. An annular blank region is arranged between the distribution region of the pressed-air outlet unit and a peripheral edge of the insole base. The blank region on two sides of a middle part and a rear part of the insole base is slightly tilted upward to form a fitting part fitting with a contour of two sides of a midfoot and a contour of a hindfoot.

Through such arrangements, the portion between the forefoot region and the hindfoot region of the insole base is the main contact region of the foot and the insole, and the plurality of pressed-air outlet units are densely arranged in this portion of the insole base, which satisfies the requirement of ergonomic design. Each pressed-air outlet unit can discharge air accordingly. The fitting part is configured to well match the insole with the foot, especially the two sides of the midfoot and the hindfoot, which improves the comfort.

Further, the insole base is provided with a plurality of second pits at lower positions thereof corresponding to the blank region, wherein no pressed-air outlet unit is arranged in the plurality of second pits. The plurality of second pits are distributed between the first pits and the peripheral edge of the insole base, and the second pit has the same shape and structure as the first pit and is formed by enclosing with the convex ribs. Heights of the convex ribs surrounding and forming the plurality of second pits gradually decrease toward the peripheral edge of the insole base.

Through such arrangements, the second pits are configured to improve the aesthetics of the insole base, and enhance the anti-skid effect between the insole base and the sole. Since the heights of the convex ribs of the plurality of second pits are set to gradually decrease toward the peripheral edge of the insole base, the periphery of the insole and the insole are matched well, which improves the comfort.

Further, a plurality of third pits is provided in the lower part of the insole base, wherein no pressed-air outlet unit is arranged in the plurality of third pits; the third pit has the same shape and structure as the first pit and is formed by enclosing with the convex ribs. The insole base is provided with massage protrusions at upper positions thereof corresponding to the third pits, and a magnet is provided in the massage protrusion.

Through such arrangements, the massage protrusions are configured to stimulate and massage the acupoints of the sole of the foot, improving comfort, and making the insole have a health care function.

Further, heights of convex columns of the plurality of pressed-air outlet units provided corresponding to the forefoot region gradually decrease toward a front end of the insole base; a midfoot region is provided between the forefoot region and the hindfoot region of the insole base. Heights of convex columns of the plurality of pressed-air outlet units provided corresponding to the midfoot region gradually decrease toward two sides of the insole base.

Through such arrangements, the higher convex columns are distributed in a high-stress region between the sole of the foot and the insole, and the lower convex columns are distributed in a low-stress region, so that the thickness of the insole varies in different regions when stepping, which satisfies the requirement of ergonomic design, and improves the comfort when being worn.

Further, a lower end of the convex column is provided with a lower air hole that communicates with the cavity.

Through such arrangements, the lower air hole is configured to discharge some air downward when the air sac part is pressed and deformed, and can also be used for air intake, improving the deformation and restoration effect of the air sac part.

Further, the lower end of the convex column is provided with a suction disk, and the lower air hole is provided on the suction disk.

Through such arrangements, the suction disk is configured to generate a certain suction force when the foot is stepping, improving the anti-skid effect between the insole and the sole.

DETAILED DESCRIPTION OF THE EMBODIMENTS

Figure 1:
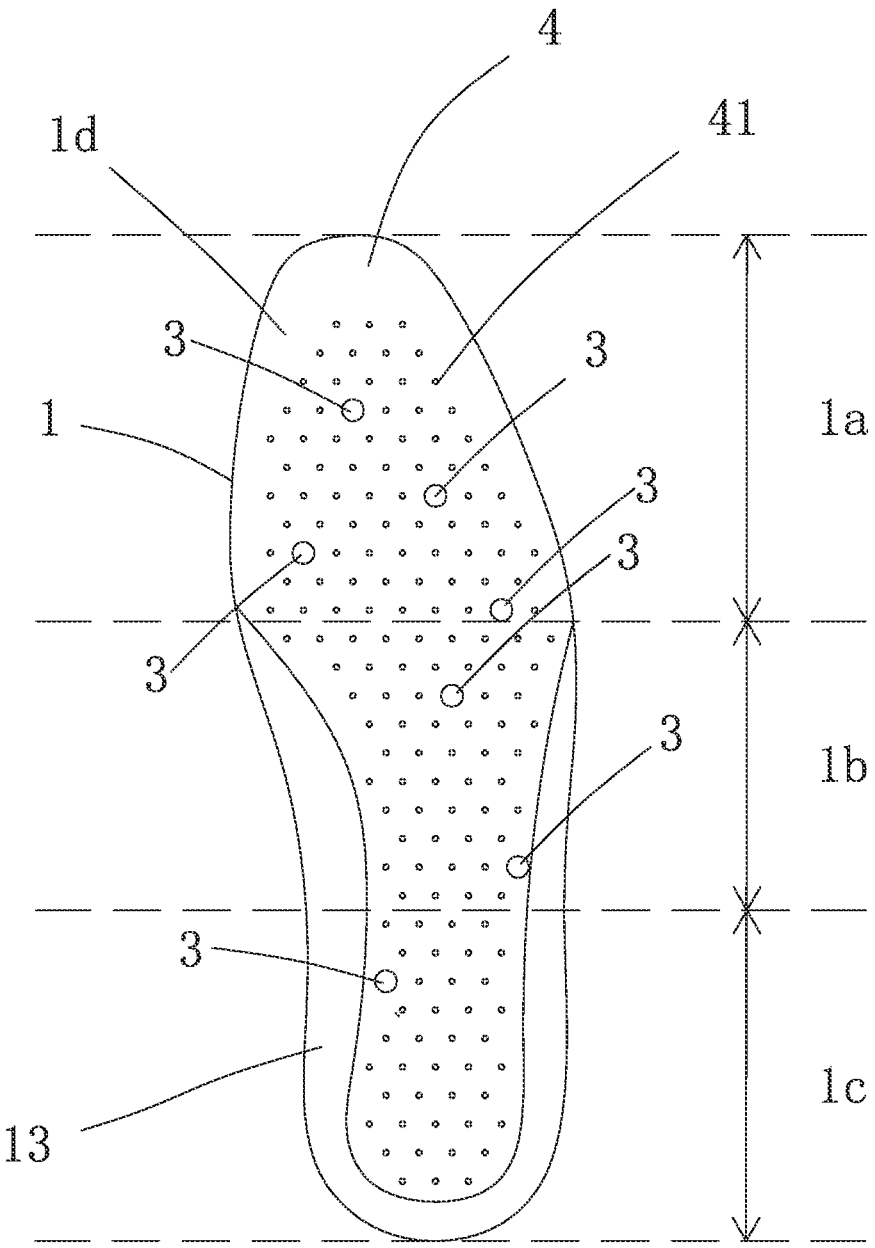
FIG. 1 is a top view of an embodiment of the present invention.

As shown in FIGS. 1-7, an embodiment of the walking-assisted air-jet insole of the present invention includes an insole base 1 made of a silicone material with good elasticity. A plurality of pressed-air outlet units 2 that can generate airflow based on stepping pressure are provided on the insole base 1. The pressed-air outlet unit 2 includes a cavity 21 for retaining air. An upper part of the insole base 1 is provided with an upper air hole 22 that communicates with the cavity 21, and a lower part of the insole base 1 is provided with an air sac part 23 that is elastically deformed and restored based on the stepping pressure. The volume of the cavity 21 may be changed based on the elastic deformation and restoration of the air sac part 23. When the air sac part 23 is pressed and deformed, the volume of the cavity 21 is reduced, thereby enabling the retained air in the cavity 21 to be discharged along the upper air hole 22 toward the upper part of the insole base 1. Of course, the upper air hole 22 may also be used for air intake. When the stepping pressure disappears, the air sac part 23 can also be restored based on its own elasticity. The volume of the cavity 21 increases during the restoration of the air sac part 23, and at the same time, external air can enter the cavity 21 along the upper air hole 22 for the next discharge.

Figure 5:
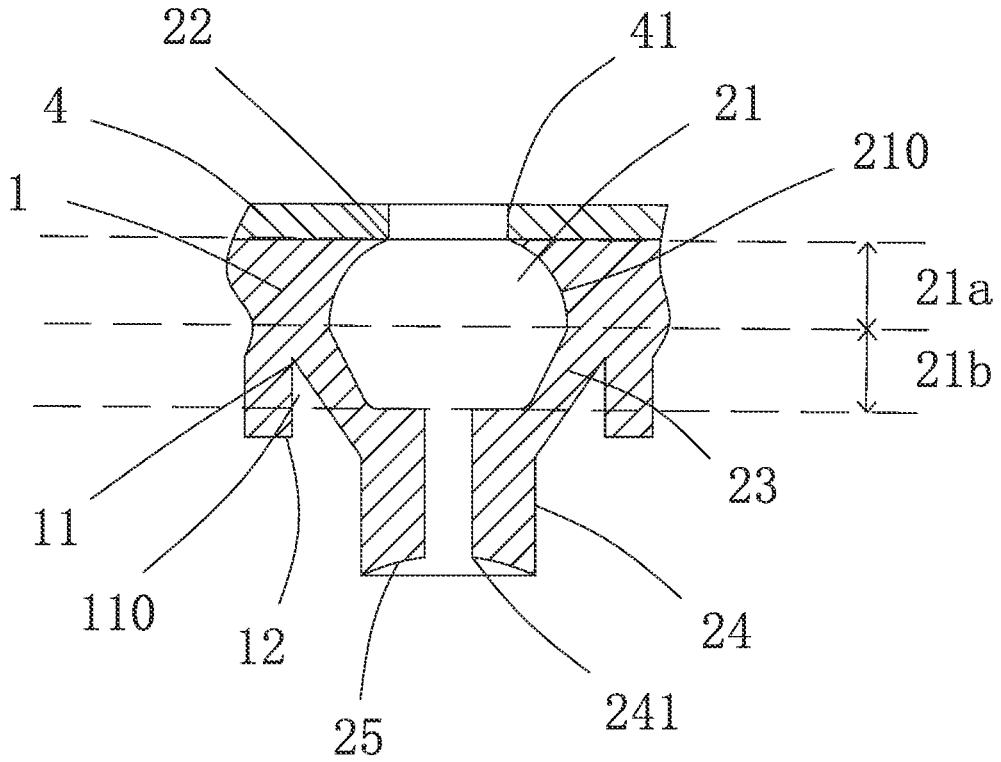
FIG. 5 is a schematic structural view of a pressed-air outlet unit according to an embodiment of the present invention.
Figure 6:
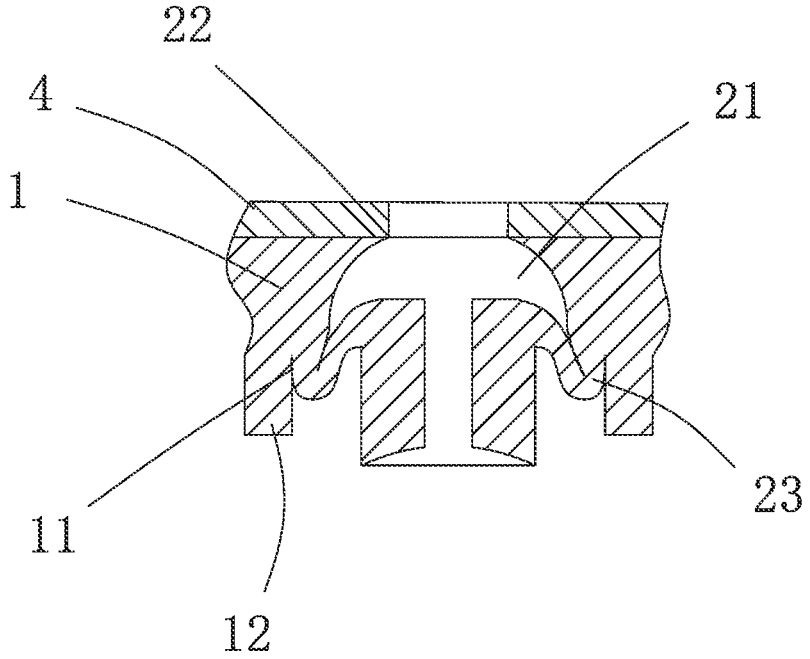
FIG. 6 is a schematic structural view of another use state of FIG. 5.
Figure 7:
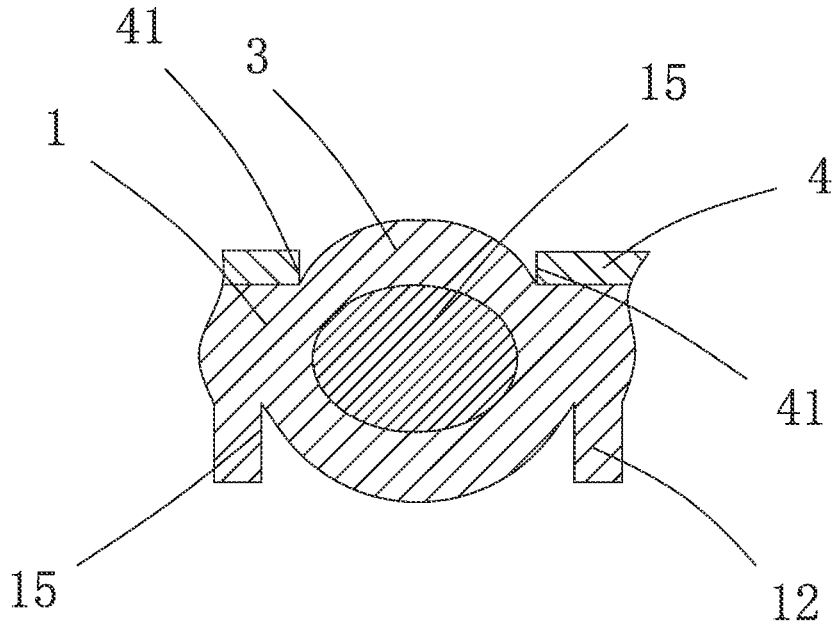
FIG. 7 is a schematic structural view of a massage protrusion according to an embodiment of the present invention.

A lower end of the air sac part 23 is provided with a convex column 24 that moves up and down based on the stepping pressure. The cavity 21 includes an upper cavity portion 21*a* and a lower cavity portion 21*b* from top to bottom, and the upper cavity portion 21*a* is located at a position between upper and lower surfaces of the insole base 1. In this way, the structure of the insole is more compact and thinner. An upper end of the upper cavity portion 21*a* is connected to the upper air hole 22. An inner diameter of the upper cavity portion 21*a* gradually increases from top to bottom to form a bowl-shaped containing space 210. A contour of a side wall section of the upper cavity portion 21*a* is designed to be arc-shaped as shown in FIG. 5. Of course, it may also be linear. At least an upper end of the convex column 24 can be inserted in the containing space 210 when the convex column 24 is driven to move upward (as shown in FIG. 6). In this way, the movement distance of the convex column 24 can increase to enhance the air discharge effect.

Since the inner diameter of the upper cavity portion 21*a* gradually increases from top to bottom, the inner wall of the upper cavity portion 21*a* can guide the convex column 24, so that the convex column 24 is more easily inserted into the upper cavity portion 21*a*, and the stability of its operation is improved. The air sac part 23 includes an annular elastic thin wall, and the lower cavity portion 21*b* is formed by enclosing with the elastic thin wall. An inner diameter of the lower cavity portion 21*b* gradually decreases from top to bottom, and a lower end of the lower cavity portion 21*b* is connected to the convex column 24. The thickness of the elastic thin wall is evenly distributed, and the cross-sectional profile of the elastic thin wall is linear as shown in FIG. 5. Of course, it may also be arc-shaped. The elastic thin wall with the above-mentioned structure can make the deformation state thereof more stable when it is pressed, and make the direction of the action force when it is elastically restored keep unchanged. The resilience of the insole can be improved, and the overall walking-assisted effect of the insole can be improved.

The lower part of the insole base 1 is provided with a plurality of first pits 11 for containing the air sac parts 23 of the pressed-air outlet units 2. Gaps 110 for elastic deformation of the air sac part in the circumferential direction are formed at intervals between peripheral side walls of the first pits 11 and the air sac parts 23. When the air sac part 23 is pressed and deformed, the peripheral side walls of the first pit 11 can provide some support for the air sac part and limit the deformation range of the air sac part, stabilize the deformation state of the air sac part and lower the probability of damage due to excessive deformation, which can increase the service life of the air sac part.

The first pit 11 is formed by enclosing with convex ribs 12 provided at the lower part of the insole base 1. The convex rib 12 and the insole base 1 are molded into a piece during manufacturing. The peripheral side wall of the first pit 11 is provided by the convex ribs 12, and a side wall between adjacent first pits 11 shares the same convex rib 12. The plurality of first pits 11 are distributed in a grid pattern, so that the plurality of first pits 11 are closer to each other and subjected the uniform force. The plurality of first pits 11 are in a honeycomb shape, each of the first pits 11 is a regular hexagon. When the air sac part 32 is pressed and deformed, the peripheral outer side of the air sac part 32 and the convex rib 12 are subjected the uniform force, and the aesthetics can also be improved. Of course, in other embodiments, the first pit 11 may also be square, diamond, circular, or the like.

Figure 2:
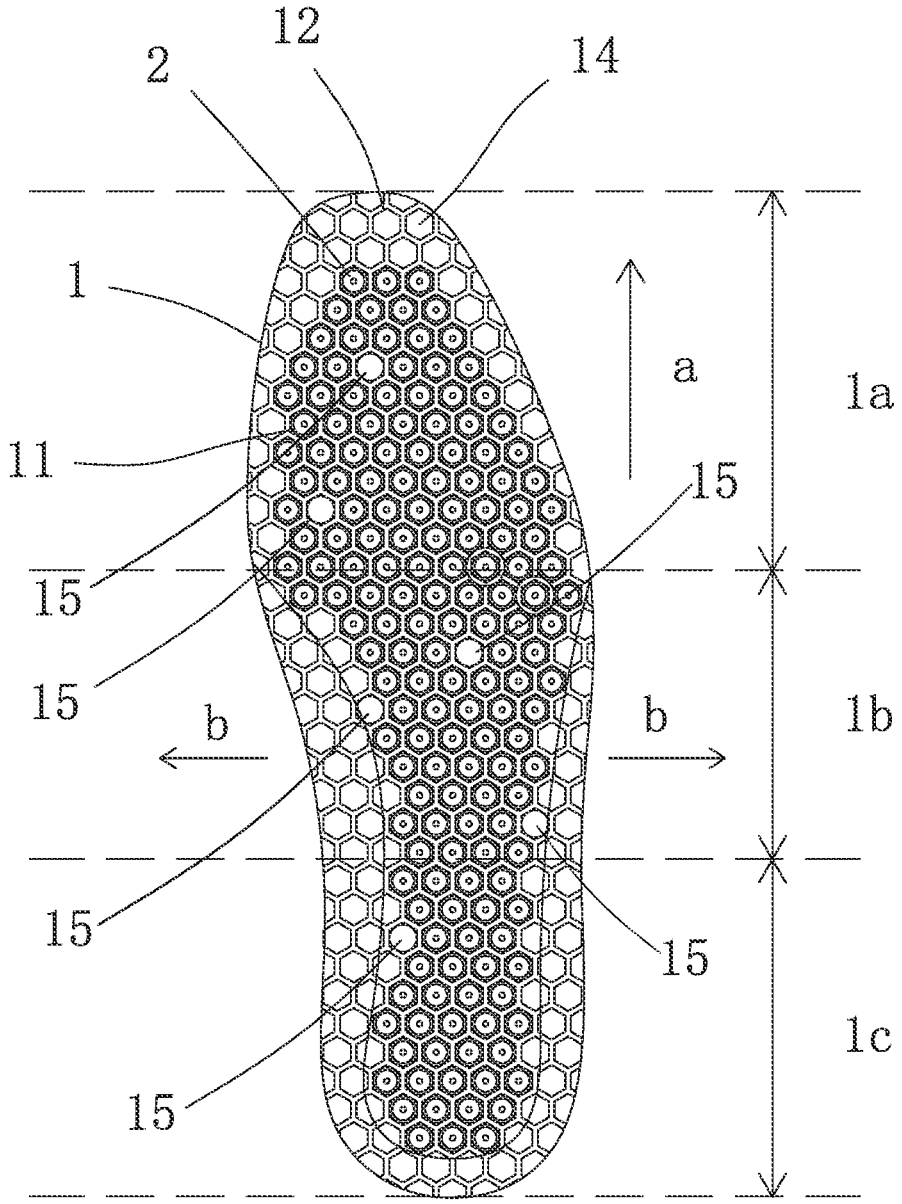
FIG. 2 is a bottom view of an embodiment of the present invention.
Figure 3:
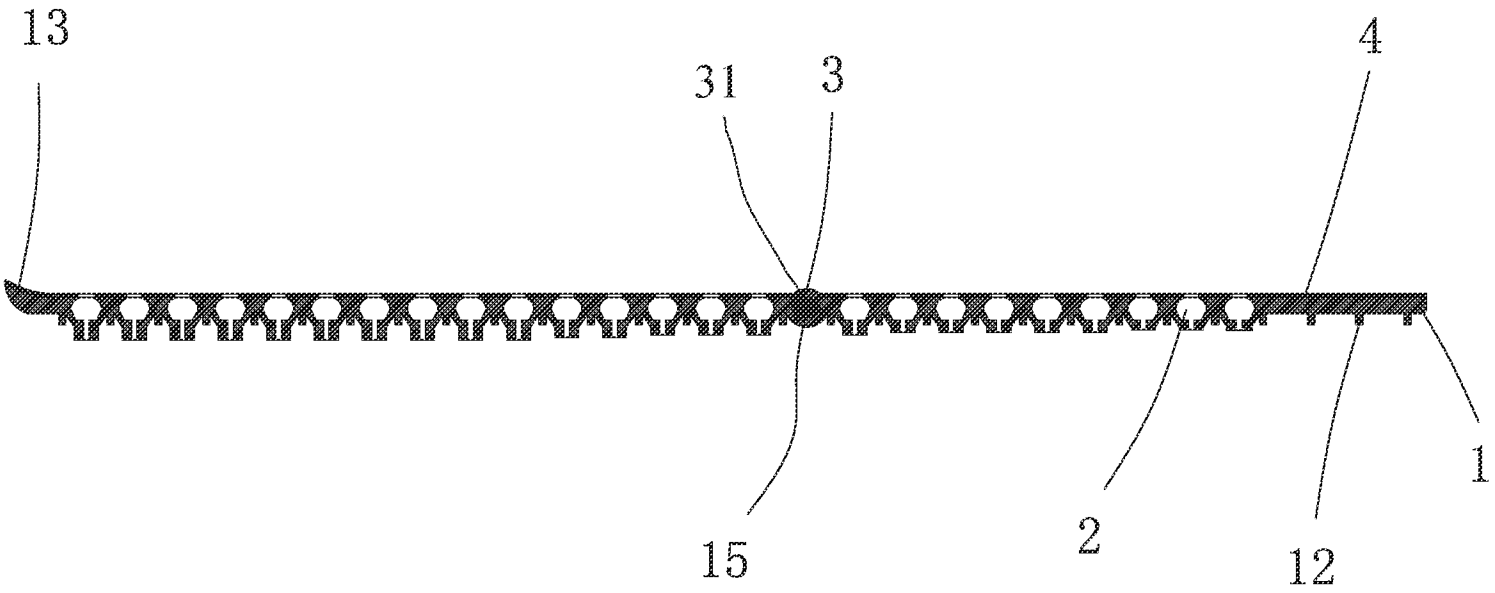
FIG. 3 is a longitudinal partial cross-sectional view of an embodiment of the present invention.
Figure 4:
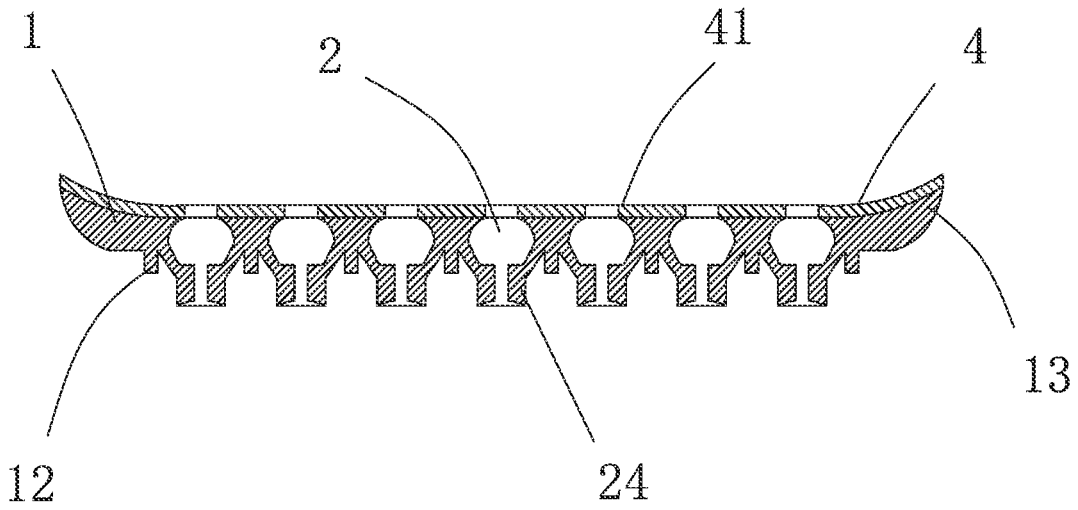
FIG. 4 is a horizontal partial cross-sectional view of an embodiment of the present invention.

As shown in FIGS. 1 and 2, the insole base 1 includes a forefoot region 1*a*, a midfoot region 1*b*, and a hindfoot region 1*c* in order from front to back. The plurality of pressed-air outlet units 2 are densely distributed on the forefoot region 1*a*, the midfoot region 1*b*, and the hindfoot region 1*c* of the insole base 1. There is an annular blank region 1*d* between the distribution region of the pressed-air outlet unit 2 and a peripheral edge of the insole base 1. The blank region 1*d* means a region where no pressed-air outlet unit 2 is distributed. The blank region 1*d* on two sides of a middle part and a rear part of the insole base 1 is slightly tilted upward to form a fitting part 13 fitting with a contour of two sides of a midfoot and a contour of a hindfoot. The fitting part 13 is U-shaped in the top view (as shown in FIG. 1), and the closure of the U-shaped is provided corresponding to the position of the hindfoot. The fitting part 13 is configured to well match the insole with the foot and improve the wearing comfort. Of course, the fitting part 13 can also perform limitation on the foot to keep the position between the foot and the insole accurate.

As shown in FIG. 2, the insole base 1 is provided with a plurality of second pits 14 is arranged at lower positions corresponding to the blank region 1*d*, wherein no pressed-air outlet unit 2 is provided in the plurality of second pits 14. The plurality of second pits 14 are distributed between the first pits 11 and the peripheral edge of the insole base 1. The second pit 14 has the same shape and structure as the first pit 11 and is also formed by enclosing with the convex ribs 12. Moreover, the same convex rib 12 is used as a side wall between adjacent second pits 14, and a side wall between adjacent first pit and second pit 14 shares the same convex rib 12. The heights of the convex ribs 12 surrounding and forming the plurality of second pits 14 are set to gradually decrease toward the peripheral edge of the insole base 1. The second pit 14 is configured to improve the anti-skid effect between the insole and the sole, and the use of the reduced distribution design can improve the wearing comfort.

A plurality of third pits 15 are provided in the lower part of the insole base 1, where no pressed-air outlet unit 2 is arranged in the plurality of third pits 15. The third pit 15 has the same shape and structure as the first pit 11 and is formed by enclosing with the convex ribs 12. Moreover, a side wall between adjacent first pit 11 and third pit 15 or between adjacent second pit 14 and third pit 15 share the same convex rib 12. The third pits 15 can be distributed in the forefoot region 1*a*, the midfoot region 1*b*, and the hindfoot region 1*c* of the insole base 1, wherein the force is frequently applied in the forefoot region 1*a*, the midfoot region 1*b*, and the hindfoot region 1*c*. Of course, the third pits 15 may also be distributed on the annular blank region 1*d*. The insole base 1 is provided with massage protrusions 3 protruding from the upper surface of the insole base 1 at upper positions of the insole base 1 corresponding to the third pits 15. The massage protrusion 3 may be provided at a position corresponding to an acupoint on the sole of the foot. A magnet 31 is provided in the massage protrusion 3. The magnet 31 is located at a position between the upper and lower surfaces of the insole base 1. A lower part of the massage protrusion 3 is provided in the third pit 15 and protrudes downward. The magnet 31 is protected by the upper and lower parts of the massage protrusion 3. The magnet 31 will not be detached from the insole base 1, and also the user's foot barely feel the magnet 31, which improves the health care performance and comfort of the insole.

The heights of the convex columns 24 of the plurality of pressed-air outlet units 2 provided corresponding to the forefoot region 1*a* are designed to gradually decrease toward the front end of the insole base 1 (as shown in the direction of arrow a in FIG. 2). The heights of the convex columns 24 of the plurality of pressed-air outlet units 2 provided corresponding to the midfoot region 1*b* are designed to gradually decrease toward two sides of the insole base 1 (as shown in the direction of arrow b in FIG. 2). The heights of the convex columns 24 of the pressed-air outlet units 2 in the hindfoot region 1*c* are uniform. This design is more ergonomic, and the resilience, air ventilation, and thickness of the insole at different positions can all correspond to the force applied on the foot, which can improve the comfort during wearing.

A lower end of the convex column 24 is provided with a lower air hole 241 that communicates with the cavity 21. The lower air hole 241 may be used for air intake, or for air discharge. The lower air hole 241 is configured to improve the air ventilation effect of the insole. The lower end of the convex column 24 is provided with a suction disk. The suction disk includes a notch 25 opened at the bottom of the convex column 24. The lower air hole 241 is provided in the notch 25. In this way, the insole can be partly held to the sole of the shoe each time the air is discharged, so that the insole is not easily separated from the sole of the shoe.

In order to improve the antibacterial and thermal insulation performance of the insole, the upper part of the insole base 1 is laid with an antibacterial layer or thermal insulation layer 4, and a through hole 41 is provided at its position corresponding to the upper air hole 22 and the massage protrusion 3. The upper part of the massage protrusion 3 passes through the through hole 41 and then extends upward.

Figure 8:
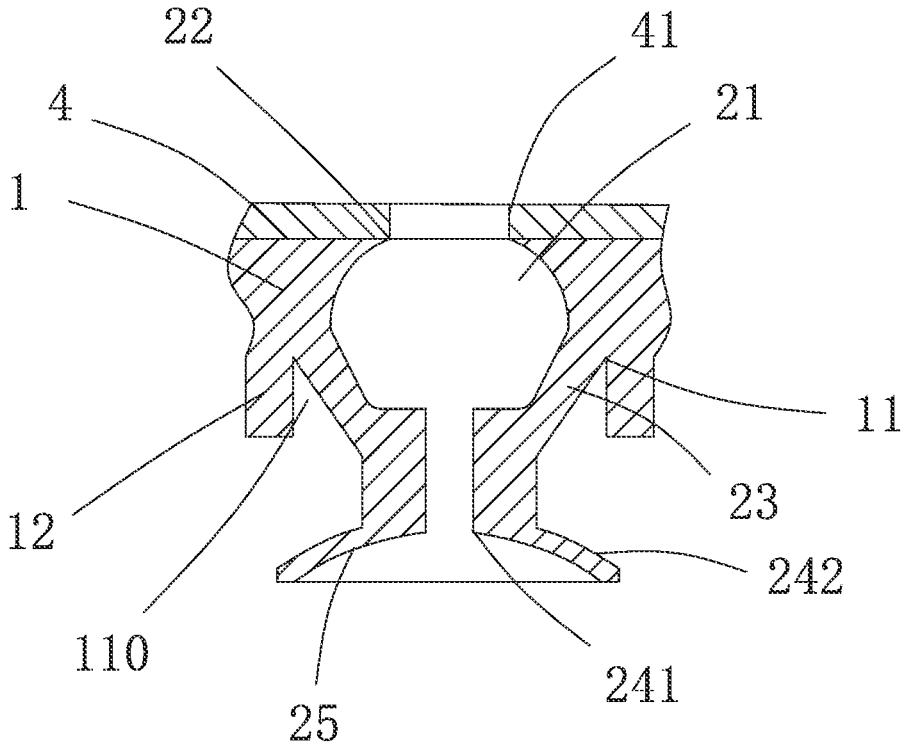
FIG. 8 is a schematic structural view of a second embodiment of the pressed-air outlet unit of the present invention.

The pressed-air outlet unit of the present invention may also adopt a structure as shown in FIG. 8, wherein the lower end of the convex column 24 extends in the circumferential direction to form a disk body 242, and the lower air hole 241 is provided at a lower end of the disk body 242. The disk body 242 is configured to further increase the adsorption between the sole and the insole, so that there is less displacement between the walking-assisted air-jet insole and the sole. Moreover, the air discharge effect of the upper air hole 22 may be also improved since the disc body 242 is tightly matched with the sole.

Figure 9:
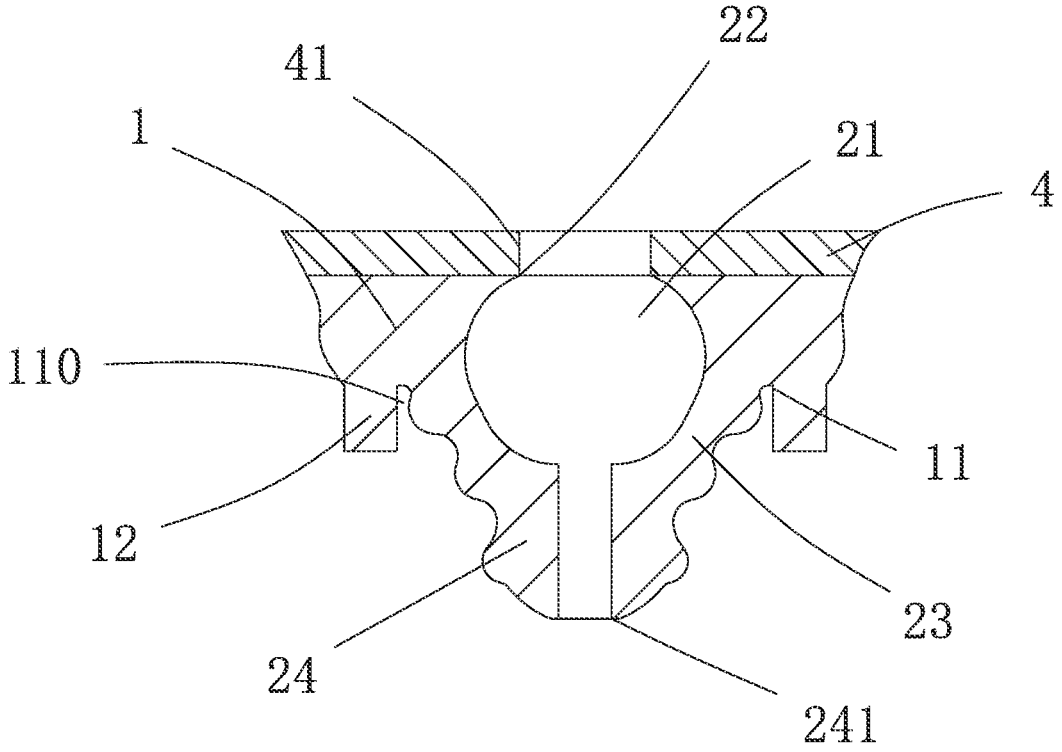
FIG. 9 is a schematic structural view of a third embodiment of the pressed-air outlet unit of the present invention.

The pressed-air outlet unit of the present invention may also adopt a structure as shown in FIG. 9, wherein the air sac part 23 of the pressed-air outlet unit includes an annular elastic thin wall. An outer side of the elastic thin wall is corrugated. An inner side of the elastic thin wall is arc-shaped, and surrounds and forms the lower cavity portion 21*b*. This arrangement can improve the elastic deformation and restoration effect of the air sac part 23, and improve the walking-assisted effect of the insole.

The above embodiment is only one of the preferred specific embodiments of the present invention, and the usual changes and substitutions made by those skilled in the art within the scope of the technical solution of the present invention are all included in the protection scope of the present invention.

What is claimed is:

1. A walking-assisted air-jet insole, comprising an insole base, wherein a plurality of pressed-air outlet units are provided on the insole base and are configured to generate airflow based on stepping pressure;

each of the plurality of the pressed-air outlet units comprises a cavity for retaining air;

an upper part of the insole base is provided with an upper air hole and the upper air hole communicates with the cavity;

a lower part of the insole base is provided with an air sac part, and the air sac part is elastically deformed and restored based on the stepping pressure;

a volume of the cavity is changed based on elastic deformation and restoration of the air sac part; wherein a lower end of the air sac part is provided with a convex column, and the convex column moves up and down based on the stepping pressure;

the cavity comprises an upper cavity portion and a lower cavity portion from top to bottom;

an upper end of the upper cavity portion is connected to the upper air hole, an inner diameter of the upper cavity portion gradually increases from top to bottom to form a bowl-shaped containing space, and the bowl-shaped containing space is configured to contain an upper end of the convex column when the convex column is driven to move upward;

the air sac part comprises an annular elastic thin wall; and the lower cavity portion is formed by enclosing with the elastic thin wall, an inner diameter of the lower cavity portion gradually decreases from top to bottom, and a lower end of the lower cavity portion is connected to the convex column;

wherein the lower part of the insole base is provided with a plurality of first pits for containing air sac parts of the plurality of pressed-air outlet units, and gaps for elastic deformation of the air sac part are formed at intervals between peripheral side walls of the plurality of first pits and the air sac parts;

wherein each of the plurality of first pits is formed by enclosing with convex ribs, and the convex ribs are provided in the lower part of the insole base;

a peripheral side wall of each of the plurality of first pits is provided by the convex ribs, a same convex rib is used as a side wall between adjacent first pits, and the plurality of first pits are distributed in a grid pattern;

wherein the plurality of first pits and convex ribs are located above a lower end of the convex column;

when the convex column is moved upward, the area between the convex ribs and the convex column forms a protrusion, and the convex ribs are configured to limit the position of the air sac part and the degree of deformation of the air sac part when the air sac part is deformed.

2. The walking-assisted air-jet insole according to claim 1, wherein the plurality of pressed-air outlet units are densely distributed between a forefoot region and a hindfoot region of the insole base;

an annular blank region is provided between a distribution region of the plurality of pressed-air outlet units and a peripheral edge of the insole base; and the annular blank region on two sides of a middle part and a rear part of the insole base is slightly tilted upward to form a fitting part, and the fitting part fits with a contour of two sides of a midfoot and a contour of a hindfoot.

3. The walking-assisted air-jet insole according to claim 2, wherein the insole base is provided with a plurality of second pits at lower positions corresponding to the annular blank region, and no pressed-air outlet unit is arranged in the plurality of second pits;

the plurality of second pits are distributed between the first pits and the peripheral edge of the insole base;

each of the plurality of second pits has the same shape and structure as each of the plurality of first pits and is formed by enclosing with the convex ribs; and heights of the convex ribs surrounding and forming the plurality of second pits are set to gradually decrease toward the peripheral edge of the insole base.

4. The walking-assisted air-jet insole according to claim 2, wherein a plurality of third pits is provided in the lower part of the insole base, and no pressed-air outlet unit is arranged in the plurality of third pits;

each of the plurality of third pits has the same shape and structure as each of the plurality of first pit and is formed by enclosing with the convex ribs;

the insole base is provided with massage protrusions at upper positions corresponding to the plurality of third pits; and a magnet is provided in each of the massage protrusions.

5. The walking-assisted air-jet insole according to claim 2, wherein heights of convex columns of the plurality of pressed-air outlet units provided corresponding to the forefoot region gradually decrease toward a front end of the insole base;

a midfoot region is included between the forefoot region and the hindfoot region of the insole base; and heights of convex columns of the plurality of pressed-air outlet units provided corresponding to the midfoot region gradually decrease toward two sides of the insole base.

6. The walking-assisted air-jet insole according to claim 1, wherein lower end of the convex column is provided with a lower air hole, and the lower air hole communicates with the cavity.

7. The walking-assisted air-jet insole according to claim 6, wherein the lower end of the convex column is provided with a suction disk, and the lower air hole is provided on the suction disk.

8. The walking-assisted air-jet insole according to claim 2, wherein lower end of the convex column is provided with a lower air hole, and the lower air hole communicates with the cavity.

9. The walking-assisted air-jet insole according to claim 3, wherein lower end of the convex column is provided with a lower air hole, and the lower air hole communicates with the cavity.

10. The walking-assisted air-jet insole according to claim 4, wherein lower end of the convex column is provided with a lower air hole, and the lower air hole communicates with the cavity.

11. The walking-assisted air-jet insole according to claim 5, wherein lower end of the convex column is provided with a lower air hole, and the lower air hole communicates with the cavity.

12. The walking-assisted air-jet insole according to claim 8, wherein the lower end of the convex column is provided with a suction disk, and the lower air hole is provided on the suction disk.

13. The walking-assisted air-jet insole according to claim 9, wherein the lower end of the convex column is provided with a suction disk, and the lower air hole is provided on the suction disk.

14. The walking-assisted air-jet insole according to claim 4, wherein the plurality of third pits are positioned based on foot acupoints, the insole base is provided with massage protrusions at upper positions corresponding to the plurality of third pits, and a magnet is provided in each of the massage protrusions.

* * * * *